US008574476B2

(12) United States Patent
Yamada

(10) Patent No.: US 8,574,476 B2
(45) Date of Patent: Nov. 5, 2013

(54) METHOD OF MANUFACTURING EXPENDABLE SALT CORE FOR CASTING

(75) Inventor: Youji Yamada, Shizuoka (JP)

(73) Assignee: Buhler AG, Uzwil (CH)

( * ) Notice: Subject to any disclaimer, the term of this patent is extended or adjusted under 35 U.S.C. 154(b) by 142 days.

(21) Appl. No.: 12/991,490

(22) PCT Filed: May 11, 2009

(86) PCT No.: PCT/JP2009/058785

§ 371 (c)(1),
(2), (4) Date: Nov. 8, 2010

(87) PCT Pub. No.: WO2009/136650

PCT Pub. Date: Nov. 12, 2009

(65) Prior Publication Data

US 2011/0062624 A1 Mar. 17, 2011

(30) Foreign Application Priority Data

May 9, 2008 (JP) ..... 2008-123972

(51) Int. Cl.
*B22C 9/10* (2006.01)

(52) U.S. Cl.
USPC ..... 264/219; 164/28; 164/522; 164/369

(58) Field of Classification Search
USPC ..... 264/219; 164/28, 522, 369
See application file for complete search history.

(56) References Cited

U.S. PATENT DOCUMENTS

| | | | | |
|---|---|---|---|---|
| 3,372,898 | A * | 3/1968 | Townsend et al. | 249/61 |
| 4,840,129 | A * | 6/1989 | Jelinek | 110/229 |
| 4,840,219 | A * | 6/1989 | Foreman | 164/369 |
| 5,303,761 | A * | 4/1994 | Flessner et al. | 164/15 |
| 2006/0185815 | A1* | 8/2006 | Yaokawa et al. | 164/137 |
| 2006/0243421 | A1* | 11/2006 | Zhang et al. | 164/522 |
| 2009/0205801 | A1* | 8/2009 | Yaokawa et al. | 164/529 |
| 2011/0062624 | A1* | 3/2011 | Yamada | 264/219 |
| 2012/0048502 | A1* | 3/2012 | Anzai et al. | 164/520 |

FOREIGN PATENT DOCUMENTS

| | | | |
|---|---|---|---|
| EP | 2 022 577 A1 | | 2/2009 |
| EP | 2022577 | * | 2/2009 |
| JP | 48-39696 B | | 11/1973 |
| JP | 50-136225 A | | 10/1975 |
| JP | 52-10803 B | | 3/1977 |
| WO | 2007/135995 A1 | | 11/2007 |

OTHER PUBLICATIONS

Official Communication issued in International Patent Application No. PCT/JP2009/058785, mailed on Jul. 14, 2009.

Sundman et al., "The Thermo-Calc Databank System", CALPHAD, 1985, pp. 153-190, vol. 9, No. 2.

(Continued)

*Primary Examiner* — Christina Johnson
*Assistant Examiner* — Saeed Huda
(74) *Attorney, Agent, or Firm* — Keating & Bennett, LLP

(57) ABSTRACT

A melt is made by heating a salt mixture containing a salt of sodium. The melt is set at a temperature higher than the liquidus temperature of the salt mixture, and poured into a mold for expendable core molding. The temperature when the melt is completely poured into the mold is set within a range not exceeding the liquidus temperature of the salt mixture by 30° C. An expendable salt core for casting is molded by solidifying the melt inside the mold. This makes it possible to more stably obtain the strength of a water-soluble expendable salt core for casting made of a salt cast product obtained by melting and molding salts of sodium and the like.

4 Claims, 4 Drawing Sheets

(56) References Cited

OTHER PUBLICATIONS

Yaokawa et al., "Thermodynamic Assessment of the KCI-K2CO3-NaCl-Na2CO3 System", Computer Coupling of Phase Diagrams and Thermochemistry 31, 2007, pp. 155-163, Elsevier Ltd.

Yaokawa et al., "Mechanical Properties of Salt Core Comprised of Alkali Carbonate and Alkali Chloride", Journal of Japan Foundry Engineering Society, 2006, pp. 516-522, vol. 78, No. 10. Japan.

* cited by examiner

METHOD OF MANUFACTURING EXPENDABLE SALT CORE FOR CASTING

BACKGROUND OF THE INVENTION

1. Field of the Invention

The present invention relates to a method of manufacturing a water-soluble expendable salt core for casting.

2. Description of the Related Art

As is well known, casting such as aluminum die casting is a technique of casting a structure having a desired shape by injecting a melt of an aluminum alloy into a metal mold at high speed and high pressure. In casting like this, a core is used to mold a cast product having a hollow structure, e.g., a water jacket for water cooling such as a cylinder block of an internal combustion engine. A core used in a case like this is apt to receive a large impact because a metal melt injected at high speed from a gate impacts against the core. In addition, the casting pressure is high until the completion of solidification. Therefore, the core is required to have strength that can withstand a high pressure and high temperature.

Also, as is well known, the core is removed from a cast product after casting. However, if a general sand expendable core solidified by a phenolic resin is used for a cast product having a complicated internal structure, it is not easy to remove the expendable core. On the other hand, water-soluble expendable salt cores removable by dissolution in high-temperature water or the like are disclosed in Japanese Patent Publication No. 48-039696, Japanese Patent Laid-Open No. 50-136225, and Japanese Patent Publication No. 52-010803. An expendable salt core is manufactured by melting and molding a salt mixture of, e.g., sodium carbonate ($Na_2CO_3$), potassium chloride (KCl), and sodium chloride (NaCl), thereby obtaining a high pressure resistance, and improving the workability and stability of casting.

As described above, an expendable salt core manufactured by melting and molding a salt mixture and having a high strength has been developed. However, expendable salt cores have large variations in strength, and hence have not completely been put into practical use.

SUMMARY OF THE INVENTION

Preferred embodiments of the present invention solve the problems as described above, and more stably obtain a practical strength of a water-soluble expendable salt core for casting made of a salt cast product obtained by melting and molding salts of sodium and the like.

A method of manufacturing an expendable salt core for casting according to a preferred embodiment of the present invention includes the steps of making a melt by heating a salt mixture containing a salt of sodium, setting a temperature of the melt at a temperature higher than a liquidus temperature of the salt mixture, and pouring the melt into a mold for expendable core molding, and molding an expendable salt core for casting by solidifying the melt inside the mold, wherein the pouring step includes the step of setting, when the melt is completely poured into the mold, the temperature of the melt within a range not exceeding the liquidus temperature of the salt mixture by 30° C.

In a preferred embodiment of the present invention, a melt of a salt mixture is heated to a temperature higher than the liquidus temperature of the salt mixture and poured into a mold for expendable core molding, and the temperature of the melt when the pouring is complete is set within a range not exceeding the liquidus temperature of the salt mixture by 30° C. This makes it possible to more stably obtain the strength of a water-soluble expendable salt core for casting made of a salt cast product obtained by melting and molding salts of sodium and the like.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
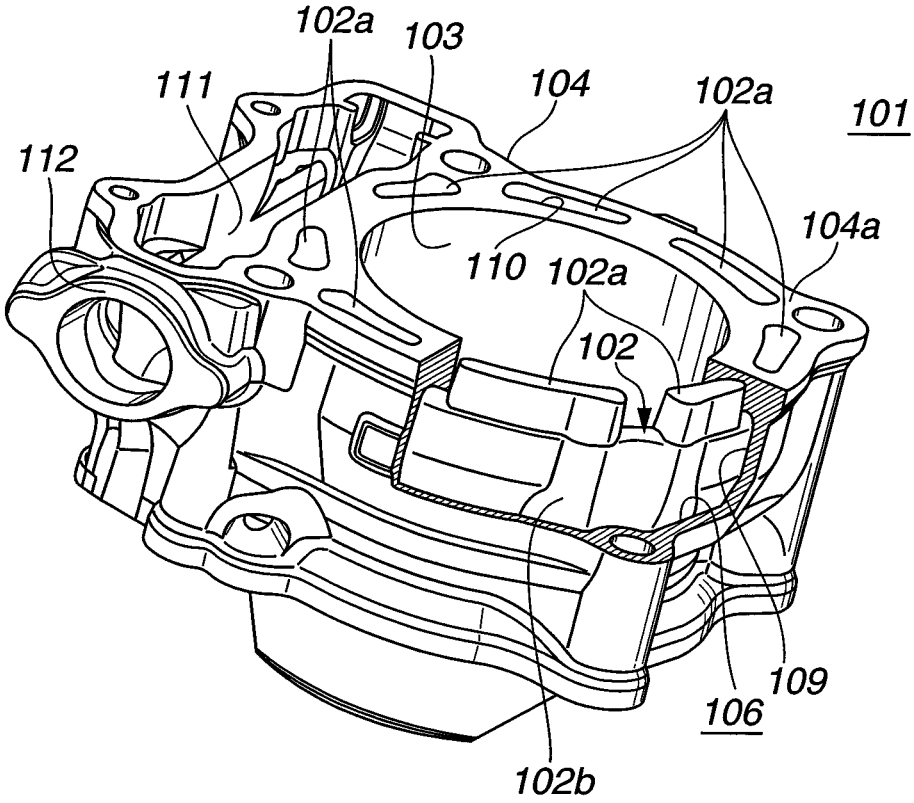
FIG. 1 is a perspective view of a cylinder block cast by using an expendable salt core for casting according to a preferred embodiment of the present invention.

Preferred embodiments of the present invention will be explained below with reference to the accompanying drawings. First, the form of use of an expendable salt core for casting according to a preferred embodiment of the present invention will be explained with reference to FIG. 1. Referring to FIG. 1, a cylinder block 101 is an engine cylinder block made of an aluminum alloy cast by using an expendable salt core 102 as the expendable salt core for casting according to the present preferred embodiment. The cylinder block 101 is a part of a water-cooling, four-cycle, single-cylinder engine for a motorcycle, and molded into a predetermined shape by die casting.

The cylinder block 101 includes a cylinder bore 103, and a cylinder body 104 including the cylinder bore 103. Although not shown, a crankcase is attached to the lower portion of the cylinder body 104. This crankcase axially supports a crankshaft via a bearing so that the crankshaft is rotatable.

The cylinder body 104 is a so-called closed deck type body. A water jacket 106 is formed inside the cylinder body 104 by using the expendable salt core 102. The water jacket 106 includes a cooling water channel formation portion (not shown), cooling water inlet (not shown), main cooling water channel 109, and communication channel 110. The cooling water channel formation portion projects from one side portion of the cylinder body 104. The cooling water inlet is formed in the cooling water channel formation portion. The main cooling water channel 109 is formed to communicate with a cooling water supply channel (not shown) formed inside of the cooling water channel formation portion, and cover the cylinder bore 103. The communication channel 110 extends upward in FIG. 1 from the main cooling water channel 109, and opens in a mating surface 104*a* for a cylinder head (not shown) at the upper end of the cylinder body 104.

The water jacket 106 described above is formed to supply cooling water flowing from the cooling water inlet to the main cooling water channel 109 around the cylinder bore 103 through the cooling water supply channel, and guide the cooling water from the main cooling water channel 109 to an internal cooling water channel of the cylinder head through the communication channel 110. Since the water jacket 106 is thus formed, the cylinder body 104 is covered with the ceiling wall (the wall forming the mating surface 104*a*) of the cylinder body 104, except that the communication channel 110 of the water jacket 106 opens in the mating surface 104*a* at the upper end to which the cylinder head is to be connected, thereby constructing a closed deck type body.

The expendable salt core 102 for forming the water jacket 106 is formed into a structure that integrally connects the individual portions of the water jacket 106. To give a better understanding of the shape of the expendable salt core 102 (the shape of the water jacket 106), FIG. 1 depicts a state in which the cylinder body 104 is partially cut away. Note that reference numeral 111 denotes a camshaft driving chain passage; and 112, a chain tensioner attaching hole.

The expendable salt core 102 according to this preferred embodiment is manufactured by making a melt by heating a salt mixture containing a salt of sodium, raising the temperature of the melt to a high temperature falling within a range not exceeding the liquidus temperature of the salt mixture by 30° C., pouring the melt into a mold for expendable core molding, and molding the melt by solidifying it inside the mold. The method of manufacturing the expendable salt core 102 will be described in detail later.

As shown in FIG. 1, the expendable salt core 102 is obtained by integrally forming the cooling water channel formation portion forming the cooling water inlet and cooling water supply channel, an annular portion 102*b* having a shape surrounding the cylinder bore 103, and a plurality of projections 102*a* projecting upward from the annular portion 102*b*. The projections 102*a* form the communication channel 110 of the water jacket 106. As is conventionally well known, the expendable salt core 102 is supported at a predetermined position inside a metal mold (not shown) by a core print (not shown) during die casting of the cylinder block 101, and removed by dissolution using hot water or vapor after casting.

The expendable salt core 102 can be removed after casting by dipping the cylinder block 101 in a dissolving bath (not shown) containing a dissolving liquid made of hydrochloric acid, hot water, and the like. When the cylinder block 101 is dipped in the dissolving liquid, the cooling water inlet of the cooling water channel formation portion of the expendable salt core 102 and the projections 102*a* exposed in the mating surface 104*a* are brought into contact with the dissolving solution and dissolved. The dissolved portions gradually extend, and all portions are finally dissolved. In this expendable core moving step, hot water or vapor may be sprayed with pressure from a hole, in order to accelerate the dissolution of the expendable salt core 102 remaining in the water jacket 106. In the expendable salt core 102, core prints can be inserted, instead of the projections 102*a*, in the prospective portions of the projections 102*a*.

Also, carbonic acid gas is foamed when using hydrochloric acid in the step of removing the expendable salt core 102 from the cylinder block 101 as a cast product. Since a stirring action is obtained by this foaming, the dissolution can effectively be promoted. Furthermore, the expendable salt core 102 contains sodium carbonate, and sodium carbonate shows alkaline properties when dissolved in water. An alkaline state like this poses the problem that, e.g., the cylinder block 101 as an aluminum cast product corrodes. The corrosion of the cylinder block can be prevented by setting the pH close to 7 by adding hydrochloric acid.

The method of manufacturing the expendable salt core 102 will be explained in detail below. The explanation will be made by taking a salt mixture obtained by mixing sodium chloride and sodium carbonate as an example of the salt mixture containing a salt of sodium. In this preferred embodiment, a salt mixture is first prepared by mixing sodium chloride and sodium carbonate, and a melt of the salt mixture is made by heating the salt mixture to a temperature higher than the melting point. For example, a salt mixture (to be referred to as 30 mol % NaCl-70 mol % $Na_2CO_3$ hereinafter) is prepared by mixing 30 mol % of sodium chloride and 70 mol % of sodium carbonate, and this salt mixture is heated to and held at a temperature higher by about 50° C. to 80° C. than the liquidus temperature of the salt mixture, thereby making an entirely dissolved melt. As an example, the salt mixture described above need only be placed in an alumina crucible and melted by an electric furnace. Note that heating the above-mentioned salt mixture produces a molten salt containing sodium ion, chlorine ion, and carbonic acid ion.

The liquidus temperature includes a conventional liquidus temperature (experimental data used in microstructure control of materials, and a liquidus temperature (calculated data) calculated by thermodynamic calculations from the thermodynamic data and mixing ratio of the constituent materials of a salt mixture. The former experimental data is obtained by measuring a temperature at which a primary a crystal starts precipitating when a salt mixture in a molten state is cooled. On the other hand, the latter calculated data is obtained by calculations by, e.g., "Thermo-Calc" by using thermodynamic data (see B. Sundman, B. Jansson, J.-O. Andresson, Calphad 9 (1985) 153. and Jun Yaokawa, Katsunari Oikawa and Koichi Anzai: "Thermodynamic Accessment of KCl—$K_2CO_3$—NaCl—$Na_2CO_3$System", CALPHAD, accepted (2007)). The liquidus temperature in this preferred embodiment is the latter calculated data.

Then, after the salt mixture contained in the crucible is completely melted, the crucible is taken out from the electric furnace and cooled with air. The cooling rate is 0.3° C. to 1.2° C. per sec. At the same time, the salt mixture in the crucible is stirred at a rotational speed of three rotations per sec by using an alumina stirrer. The crucible is cooled while the salt mixture is thus stirred, and the melt of the salt mixture starts being poured into a metal mold when the temperature of the melt of the salt mixture is 758° C. higher by 15° C. than the liquidus temperature (743° C. for 30 mol % NaCl-70 mol % $Na_2CO_3$). That is, the temperature of the melt of the salt mixture is 758° C. immediately before the melt is poured into the metal mold. The metal mold is preheated to, e.g., about 100° C.

When the melt is poured into the metal mold, the melt is cooled to a temperature (753° C.) higher by 10° C. than the liquidus temperature when pouring is complete, due to, e.g., the elapse of time to the completion of pouring and the absorption of heat to the metal mold. In other words, the above-mentioned cooling is performed such that the temperature of the melt when the melt is completely poured into the metal mold (when pouring is complete) is higher by 10° C. than the liquidus temperature. In this preferred embodiment, the temperature of the melt decreases by about 5° C. in the series of steps of pouring the melt into the metal mold. Note that in the following description, the difference between the liquidus temperature and the temperature of the melt when pouring is complete, which is higher than the liquidus temperature, will be referred to as a superheat (superheat temperature). In the above-described case, the superheat is 10° C.

Figure 2:
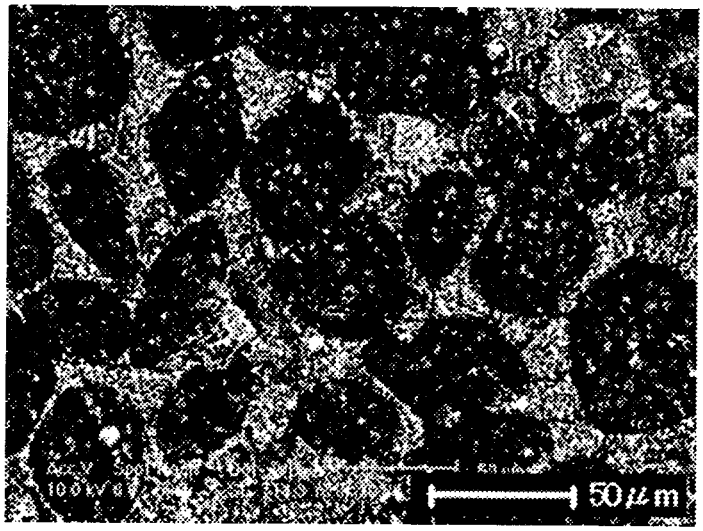
FIG. 2 is a photograph showing the result obtained by observing, with an electron microscope, a polished surface of an expendable salt core manufactured at a superheat of 10° C.

After that, an expendable salt core 102 is formed by solidifying the melt inside the metal mold. The expendable salt core 102 thus obtained has a high strength, i.e., the value of the bending strength exceeds 30 MPa. Also, as shown in a scanning electron microscope (SEM) photograph of FIG. 2, a fine granular primary a crystal (crystal grains) having a spindle shape is uniformly distributed in the solidified texture of the expendable salt core 102. In addition, analysis by an energy dispersive X-ray (EDX) diffractometer reveals that the crystal grains are made of sodium carbonate.

Figure 3:
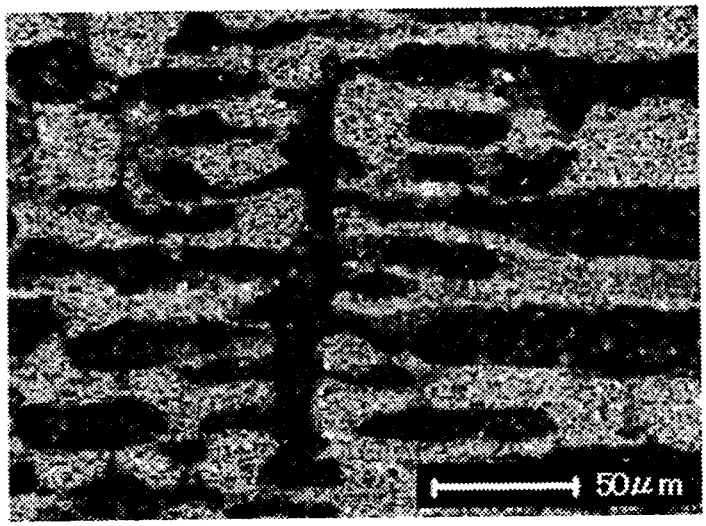
FIG. 3 is a photograph showing the result obtained by observing, with an electron microscope, a polished surface of an expendable salt core manufactured at a superheat of 40° C.

On the other hand, as shown in FIG. 3, in a manufacturing method in which the same composition is used and the superheat is set at 40° C., a dendritic crystal (dendrite microstructure) that presumably decreases the mechanical strength is observed as primary cells. Analysis by the EDX diffractometer reveals that this dendrite microstructure is also made of sodium carbonate.

Figure 4:
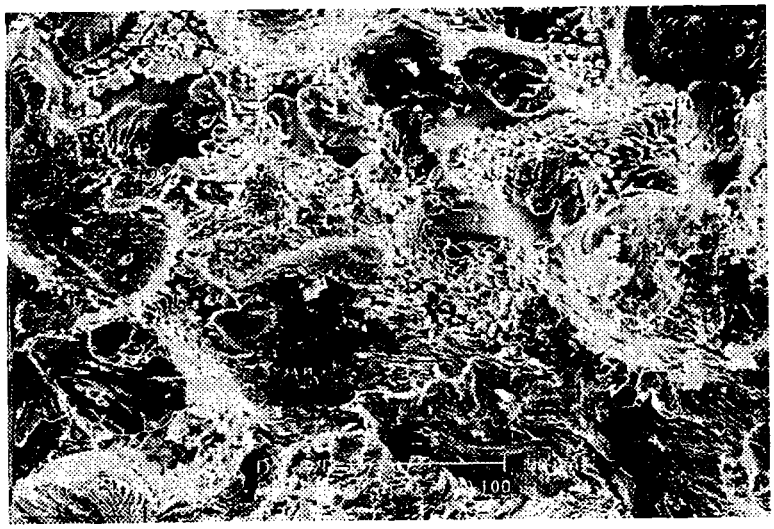
FIG. 4 is a photograph showing the result obtained by observing, with an electron microscope, a fracture surface of an expendable salt core manufactured at a superheat of 10° C.
Figure 5:
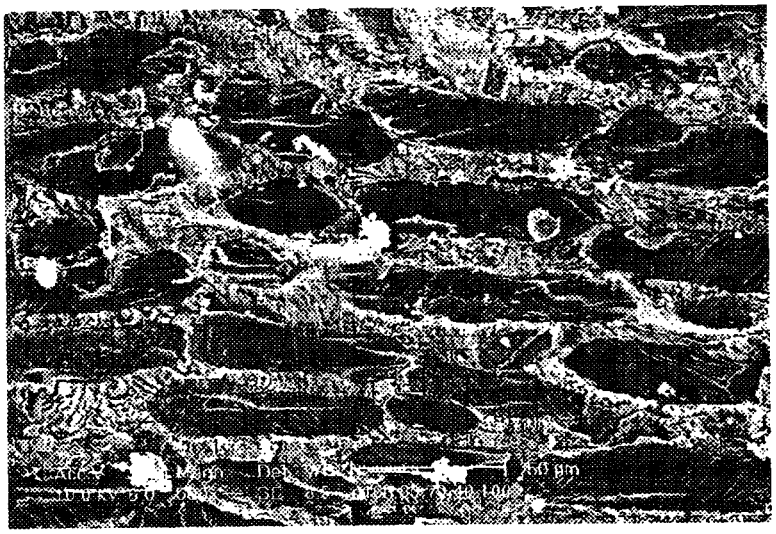
FIG. 5 is a photograph showing the result obtained by observing, with an electron microscope, a fracture surface of an expendable salt core manufactured at a superheat of 40° C.

When a fracture surface of the expendable salt core obtained by the manufacturing method in which the superheat is 10° C. is observed with the SEM, the surface has a complicated three-dimensional structure as shown in FIG. 4. By contrast, when a fracture surface of the expendable salt core obtained by the manufacturing method in which the superheat is 40° C. is observed with the SEM, the surface is two-dimensionally cracked along the dendrite microstructure as shown in FIG. 5. As described above, the dendritic crystal grains (dendrite microstructure) readily grow to form giant crystal grains, and cleavage easily occurs in these portions. This presumably decreases the strength. In this preferred embodiment, a high strength is obtained probably because no such dendrite microstructure that decreases the strength is formed.

Figure 6:
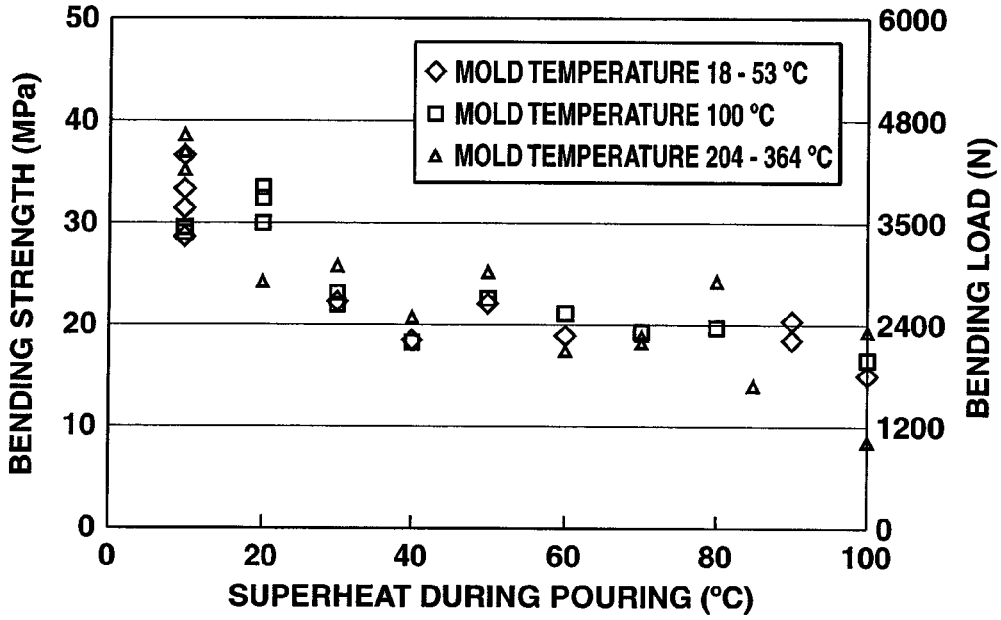
FIG. 6 is a graph showing the relationship between the superheat and strength when melt pouring is complete.

As shown in FIG. 6, a high strength as described above is perhaps obtainable as long as the superheat does not exceed 30° C. As shown in FIG. 6, the bending strength when the superheat exceeds 30° C. at the time of completion of pouring is obviously lower than that when the superheat does not exceed 30° C. In the manufacturing method according to this preferred embodiment, therefore, the temperature width of the superheat is about 30° C., so the expendable salt core 102 can be manufactured without strictly controlling the temperature and holding a constant temperature. Note that FIG. 6 shows the results of measurements of the strengths of expendable salt cores manufactured following the same procedures as above by setting the mold temperature at 18° C. to 53° C., 100° C., and 204° C. to 364° C. The mold temperature has little effect on the bending strength.

Figure 7:
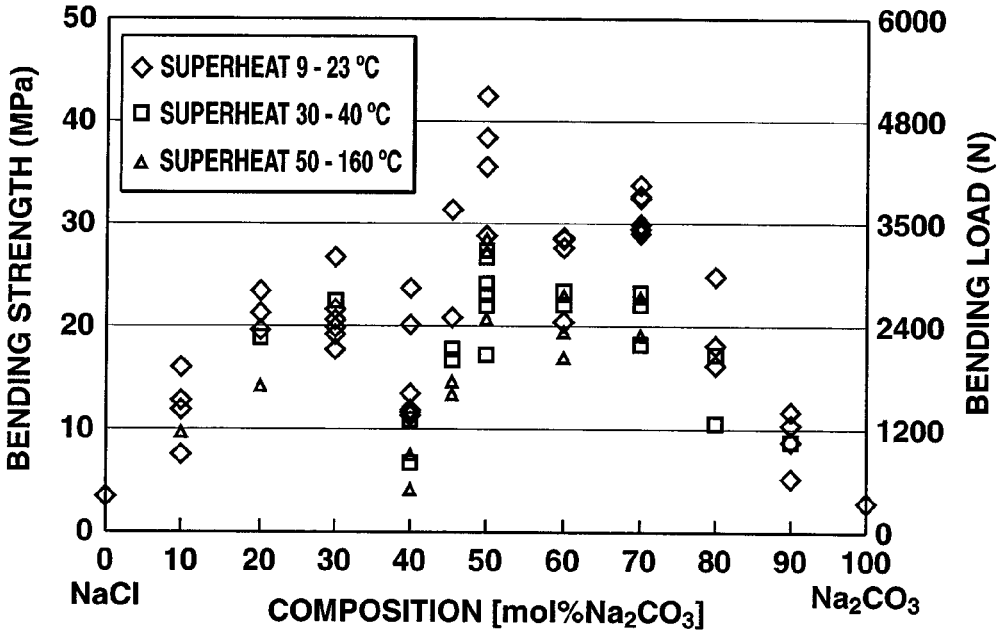
FIG. 7 is a graph showing the relationship between the mixing ratio of sodium chloride to sodium carbonate and the strength.

When manufacturing an expendable salt core by using a salt mixture obtained by mixing sodium chloride and sodium carbonate, as shown in FIG. 7, if the superheat falls within a range (9° C. to 23° C.) not exceeding 30° C., a bending strength higher than that obtained by any other superheat is obtained, regardless of the mixing ratio of sodium chloride (NaCl) to sodium carbonate ($Na_2CO_3$). The highest strength is obtained when the mixing ratio is 1:1. Note that FIGS. 6 and 7 use numerical values shown in Tables 1, 2, and 3 below. Note also that the value of 54.6 mol % NaCl-45.4 mol % $Na_2CO_3$ is obtained by thermodynamic calculations by "Thermo-Calc" in the same manner as for the liquidus temperature.

TABLE 1

| Sample Number | NaCl Ratio mol % | $Na_2CO_3$ Ratio mol % | Liquidus Temperature ° C. | Superheat ° C. | Mold Temperature ° C. | Bending Load N | Bending Strength MPa |
|---|---|---|---|---|---|---|---|
| 1 | 100 | 0 | 801 | 10 | 100 | 399 | 3.3 |
| 2 | 90 | 10 | 766 | 9 | 100 | 1933 | 16.1 |
| 3 | 90 | 10 | 766 | 9 | 100 | 902 | 7.5 |
| 4 | 90 | 10 | 766 | 10 | 100 | 1436 | 12.0 |
| 5 | 90 | 10 | 766 | 10 | 100 | 1507 | 12.6 |
| 6 | 90 | 10 | 766 | 55 | 100 | 1177 | 9.8 |
| 7 | 80 | 20 | 731 | 9 | 9 | 2547 | 21.2 |
| 8 | 80 | 20 | 731 | 9 | 9 | 2766 | 23.1 |
| 9 | 80 | 20 | 731 | 9 | 100 | 2766 | 23.1 |
| 10 | 80 | 20 | 731 | 10 | 100 | 2327 | 19.4 |
| 11 | 80 | 20 | 731 | 30 | 100 | 2259 | 18.8 |
| 12 | 80 | 20 | 731 | 62 | 100 | 1700 | 14.2 |
| 13 | 70 | 30 | 694 | 10 | 100 | 3194 | 26.6 |
| 14 | 70 | 30 | 694 | 14 | 100 | 2381 | 19.8 |
| 15 | 70 | 30 | 694 | 14 | 100 | 2458 | 20.5 |
| 16 | 70 | 30 | 694 | 14 | 100 | 2260 | 18.8 |
| 17 | 70 | 30 | 694 | 14 | 100 | 2157 | 18.0 |
| 18 | 70 | 30 | 694 | 30 | 100 | 2663 | 22.2 |
| 19 | 70 | 30 | 694 | 59 | 100 | 2557 | 21.3 |
| 20 | 60 | 40 | 654 | 10 | 100 | 2826 | 23.6 |
| 21 | 60 | 40 | 654 | 10 | 100 | 1364 | 11.4 |
| 22 | 60 | 40 | 654 | 16 | 100 | 1412 | 11.8 |
| 23 | 60 | 40 | 654 | 16 | 100 | 2388 | 19.9 |
| 24 | 60 | 40 | 654 | 16 | 100 | 1606 | 13.4 |
| 25 | 60 | 40 | 654 | 30 | 100 | 1315 | 11.0 |
| 26 | 60 | 40 | 654 | 30 | 100 | 798 | 6.6 |
| 27 | 60 | 40 | 654 | 56 | 100 | 1379 | 11.5 |
| 28 | 60 | 40 | 654 | 100 | 100 | 487 | 4.1 |
| 29 | 54.6 | 45.4 | 632 | 10 | 100 | 3751 | 31.3 |
| 30 | 54.6 | 45.4 | 632 | 10 | 100 | 2482 | 20.7 |
| 31 | 54.6 | 45.4 | 632 | 30 | 100 | 1996 | 16.6 |
| 32 | 54.6 | 45.4 | 632 | 30 | 100 | 2109 | 17.6 |
| 33 | 54.6 | 45.4 | 632 | 50 | 100 | 1618 | 13.5 |
| 34 | 54.6 | 45.4 | 632 | 160 | 100 | 1749 | 14.6 |
| 35 | 50 | 50 | 654 | 10 | 100 | 3442 | 28.7 |
| 36 | 50 | 50 | 654 | 10 | 100 | 4270 | 35.6 |
| 37 | 50 | 50 | 654 | 10 | 100 | 4632 | 38.6 |
| 38 | 50 | 50 | 654 | 10 | 100 | 5087 | 42.4 |
| 39 | 50 | 50 | 654 | 30 | 100 | 2718 | 22.6 |
| 40 | 50 | 50 | 654 | 30 | 100 | 2892 | 24.1 |

TABLE 2

| Sample Number | NaCl Ratio mol % | $Na_2CO_3$ Ratio mol % | Liquidus Temperature ° C. | Superheat ° C. | Mold Temperature ° C. | Bending Load N | Bending Strength MPa |
|---|---|---|---|---|---|---|---|
| 41 | 50 | 50 | 654 | 31 | 100 | 3188 | 26.6 |
| 42 | 50 | 50 | 654 | 31 | 100 | 2795 | 23.3 |
| 43 | 50 | 50 | 654 | 31 | 100 | 2619 | 21.8 |
| 44 | 50 | 50 | 654 | 31 | 100 | 3250 | 27.1 |
| 45 | 50 | 50 | 654 | 50 | 100 | 2482 | 20.7 |
| 46 | 50 | 50 | 654 | 90 | 100 | 3438 | 28.6 |
| 47 | 50 | 50 | 654 | 100 | 100 | 3245 | 27.0 |
| 48 | 40 | 60 | 700 | 10 | 100 | 3332 | 27.8 |
| 49 | 40 | 60 | 700 | 10 | 100 | 3439 | 28.7 |
| 50 | 40 | 60 | 700 | 10 | 100 | 3347 | 27.9 |
| 51 | 40 | 60 | 700 | 23 | 100 | 3413 | 28.4 |
| 52 | 40 | 60 | 700 | 23 | 100 | 2790 | 23.2 |
| 53 | 40 | 60 | 700 | 23 | 100 | 2442 | 20.4 |
| 54 | 40 | 60 | 700 | 30 | 100 | 2730 | 22.8 |
| 55 | 40 | 60 | 700 | 30 | 100 | 2773 | 23.~ |
| 56 | 40 | 60 | 700 | 30 | 100 | 2648 | 22.1 |
| 57 | 40 | 60 | 700 | 50 | 100 | 2367 | 19.7 |
| 58 | 40 | 60 | 700 | 100 | 100 | 2031 | 16.9 |
| 59 | 40 | 60 | 700 | 100 | 100 | 2737 | 22.8 |
| 60 | 30 | 70 | 743 | 10 | 18 | 3991 | 33.3 |
| 61 | 30 | 70 | 743 | 10 | 100 | 3469 | 28.9 |
| 62 | 30 | 70 | 743 | 10 | 100 | 3519 | 29.3 |
| 63 | 30 | 70 | 743 | 10 | 100 | 3552 | 29.6 |
| 64 | 30 | 70 | 743 | 10 | 204 | 4628 | 38.6 |

TABLE 2-continued

| Sample Number | NaCl Ratio mol % | $Na_2CO_3$ Ratio mol % | Liquidus Temperature ° C. | Superheat ° C. | Mold Temperature ° C. | Bending Load N | Bending Strength MPa |
|---|---|---|---|---|---|---|---|
| 65 | 30 | 70 | 743 | 10 | 301 | 4209 | 35.1 |
| 66 | 30 | 70 | 743 | 20 | 100 | 3885 | 32.4 |
| 67 | 30 | 70 | 743 | 20 | 100 | 3904 | 32.5 |
| 68 | 30 | 70 | 743 | 20 | 100 | 4021 | 33.5 |
| 69 | 30 | 70 | 743 | 20 | 100 | 3591 | 29.9 |
| 70 | 30 | 70 | 743 | 20 | 314 | 2895 | 24.1 |
| 71 | 30 | 70 | 743 | 30 | 18 | 2679 | 22.3 |
| 72 | 30 | 70 | 743 | 30 | 100 | 2755 | 23.0 |
| 73 | 30 | 70 | 743 | 30 | 100 | 2616 | 21.8 |
| 74 | 30 | 70 | 743 | 30 | 100 | 2620 | 21.8 |
| 75 | 30 | 70 | 743 | 30 | 300 | 3081 | 25.7 |
| 76 | 30 | 70 | 743 | 40 | 18 | 2218 | 18.5 |
| 77 | 30 | 70 | 743 | 40 | 100 | 2185 | 18.2 |
| 78 | 30 | 70 | 743 | 40 | 288 | 2473 | 20.6 |
| 79 | 30 | 70 | 743 | 50 | 18 | 2661 | 22.2 |
| 80 | 30 | 70 | 743 | 50 | 100 | 2717 | 22.6 |

TABLE 3

| Sample Number | NaCl Ratio mol % | $Na_2CO_3$ Ratio mol % | Liquidus Temperature ° C. | Superheat ° C. | Mold Temperature ° C. | Bending Load N | Bending Strength MPa |
|---|---|---|---|---|---|---|---|
| 81 | 30 | 70 | 743 | 50 | 294 | 3009 | 25.1 |
| 82 | 30 | 70 | 743 | 60 | 20 | 2269 | 18.9 |
| 83 | 30 | 70 | 743 | 60 | 102 | 2521 | 21.0 |
| 84 | 30 | 70 | 743 | 60 | 293 | 2080 | 17.3 |
| 85 | 30 | 70 | 743 | 70 | 99 | 2299 | 19.2 |
| 86 | 30 | 70 | 743 | 70 | 289 | 2295 | 19.1 |
| 87 | 30 | 70 | 743 | 70 | 298 | 2215 | 18.5 |
| 88 | 30 | 70 | 743 | 80 | 96 | 2367 | 19.7 |
| 89 | 30 | 70 | 743 | 80 | 298 | 2918 | 24.3 |
| 90 | 30 | 70 | 743 | 85 | 326 | 1694 | 14.1 |
| 91 | 30 | 70 | 743 | 90 | 44 | 2410 | 20.1 |
| 92 | 30 | 70 | 743 | 90 | 44 | 2243 | 18.7 |
| 93 | 30 | 70 | 743 | 100 | 53 | 1805 | 15.0 |
| 94 | 30 | 70 | 743 | 100 | 100 | 1983 | 16.5 |
| 95 | 30 | 70 | 743 | 100 | 196 | 2345 | 19.5 |
| 96 | 30 | 70 | 743 | 100 | 364 | 1019 | 8.5 |
| 97 | 20 | 80 | 783 | 0 | 100 | 2198 | 18.3 |
| 98 | 20 | 80 | 783 | 10 | 100 | 2971 | 24.8 |
| 99 | 20 | 80 | 783 | 10 | 100 | 1953 | 16.3 |
| 100 | 20 | 80 | 783 | 23 | 100 | 2156 | 18.0 |
| 101 | 20 | 80 | 783 | 30 | 100 | 1265 | 10.5 |
| 102 | 20 | 80 | 783 | 30 | 100 | 2069 | 17.2 |
| 103 | 10 | 90 | 821 | 10 | 100 | 1243 | 10.4 |
| 104 | 10 | 90 | 821 | 10 | 100 | 1379 | 11.5 |
| 105 | 10 | 90 | 821 | 10 | 100 | 2294 | 19.1 |
| 106 | 10 | 90 | 821 | 16 | 100 | 1081 | 9.0 |
| 107 | 10 | 90 | 821 | 16 | 100 | 629 | 5.2 |
| 108 | 10 | 90 | 821 | 30 | 100 | 1050 | 8.7 |
| 109 | 0 | 100 | 858 | 10 | 100 | 347 | 2.9 |

In this preferred embodiment as explained above, a melt is made by heating a salt mixture containing a salt of sodium, and this melt is heated to a temperature higher than the liquidus temperature of the salt mixture, poured into a mold for expendable core molding, and solidified inside the mold, thereby molding an expendable salt core for casting. In particular, the temperature of the melt when the melt is completely poured into the mold is set within a range not exceeding the liquidus temperature of the salt mixture by 30° C. Consequently, a higher bending strength can be obtained as described previously. This makes it possible to more stably obtain a practical strength of the expendable salt core (expendable salt core for casting). For example, even when the strength varies, the range of the variation falls inside a practical strength range.

Figure 8:
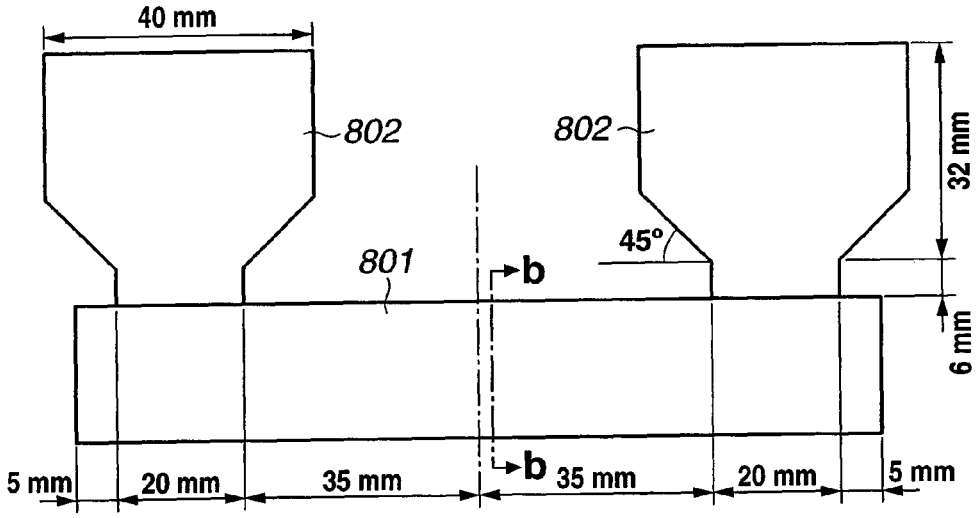
FIG. 8 is a side view of a specimen for use in bending strength measurement.
Figure 9:
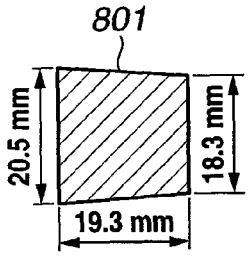
FIG. 9 is a sectional view of the specimen shown in FIG. 8.

The measurement of the bending strength will now be explained. In the measurement of the bending strength, a square-pillar-like specimen having predetermined dimensions is formed, a load is applied on the specimen, and a bending load is obtained from a maximum load required to break the specimen. First, the formation of the specimen will be explained. A bar-like specimen 801 as shown in FIGS. 8 and 9 is formed by using a predetermined metal mold. The metal mold used is made of, e.g., chromium molybdenum steel such as SCM440H. FIG. 8 shows riser parts 802 used to fill the metal mold with a semi-solidified melt, but the parts 802 are cut off in the measurement of the bending strength. Note that FIG. 8 is a side view, FIG. 9 is a sectional view taken along a line b-b in FIG. 8, and the dimensions shown in FIGS. 8 and 9 are the design values of the metal mold.

Figure 10:
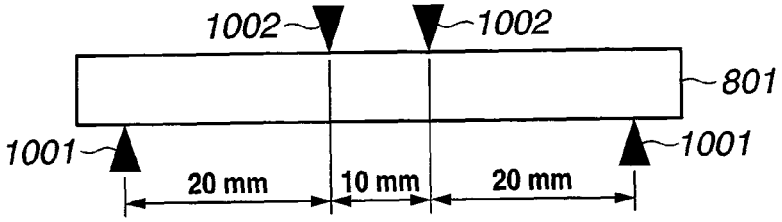
FIG. 10 is a view for explaining bending strength measurement.

The bending strength of the bar-like specimen 801 formed as described above is measured as shown in FIG. 10. First, the specimen 801 is supported by two support members 1001 arranged to form a space of 50 mm in a central portion of the specimen 801. In this state, in an intermediate portion between the two support members 1001, two loading portions 1002 spaced apart by 10 mm apply a load on the specimen 801. The load applied on the specimen 801 is gradually increased, and a load when the specimen 801 is broken is regarded as the bending load shown in Table 1.

A bending strength σ (MPa) can be calculated by an equation "$\sigma=3LP/BH^2$" from a bending load P. In this equation, H indicates the length of the section of the specimen in the loading direction, B indicates the length of the section of the specimen in a direction perpendicular to the loading direction, and L indicates the distance from the support member 1001 as a fulcrum to the loading portion 1002 that applies a load. The specimen 801 is formed by pouring a melt in a solid-liquid coexisting state into a metal mold. However, it is difficult to form a specimen having neither a flow line nor a shrinkage cavity and having a shape completely matching the mold dimensions. Therefore, the bending strength is calculated by approximating the section of the specimen to an oblong, and assuming that H≈20 mm, B≈18 mm, and L=20 mm. By this approximation, the strength is estimated to be lower by about 0% to 20% than the actual strength. For example, a specimen that breaks with a bending load of 1,200 N can be regarded as stronger than an ideal specimen having a bending strength of 10 MPa.

Note that various preferred embodiments of the present invention are also applicable to a method of molding an expendable salt core by die casting. Even when using die casting, the same effect as described above can be obtained as long as the superheat does not exceed 30° C. when a melt is completely poured into a mold (when melt injection into the mold is complete).

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A method of manufacturing an expendable salt core for casting, comprising the steps of:

making a melt of a salt mixture containing at least two salts including a salt of sodium by heating the salt mixture;

setting a temperature of the melt at a temperature higher than a liquidus temperature of the salt mixture, and pouring the melt into a mold for expendable core molding; and molding an expendable salt core for casting by solidifying the melt inside the mold; wherein the step of pouring the melt into a mold includes the step of setting, when the melt is completely poured into the mold, the temperature of the melt within a range higher by not less than 9° C. than the liquidus temperature of the salt mixture and not exceeding the liquidus temperature of the salt mixture by 30° C.

2. A method of manufacturing an expendable salt core for casting according to claim 1, wherein the step of making a melt includes the step of heating a material obtained by mixing sodium chloride and sodium carbonate, as the salt mixture.

3. A method of manufacturing an expendable salt core for casting according to claim 1, wherein the step of making a melt includes the step of producing a molten salt containing sodium ion, chlorine ion, and carbonic acid ion, by heating the salt mixture.

4. A method of manufacturing an expendable salt core for casting according to claim 1, wherein when the melt is completely poured into the mold, the temperature of the melt is higher by 9° C. to 23° C. than the liquidus temperature of the salt mixture.

* * * * *